United States Patent [19]

Palmer et al.

[11] 4,341,031

[45] Jul. 27, 1982

[54] PERCUSSION FIRING MECHANISM FOR INDUSTRIAL GUNS

[75] Inventors: John R. Palmer; Kenneth C. Rowlands, both of Utica, N.Y.

[73] Assignee: Remington Arms Company, Inc., Bridgeport, Conn.

[21] Appl. No.: 163,306

[22] Filed: Jun. 26, 1980

[51] Int. Cl.[3] ..... F41C 11/04

[52] U.S. Cl. ..... 42/23; 89/24

[58] Field of Search ..... 42/23, 84; 89/24, 27 R, 89/27 A, 149

[56] References Cited

U.S. PATENT DOCUMENTS

| | | | |
|---|---|---|---|
| 2,415,952 | 2/1947 | Loomis | 89/24 |
| 2,977,855 | 4/1961 | Catlin et al. | 89/24 |
| 3,763,742 | 10/1973 | Kotas et al. | 89/24 |

*Primary Examiner*—Charles T. Jordan

*Attorney, Agent, or Firm*—Nicholas Skovran; William L. Ericson; Barry Estrin

[57] ABSTRACT

An industrial gun, of the type having a transverse sliding breechblock, has a firing mechanism which automatically cocks and then releases a hammer as the breechblock closes. A sear is pivoted in the yoke or receiver of the gun in a position to engage and cock a hammer carried by the breechblock as the breechblock is moved from an open to a closed position. A cam surface on the sear bears against a cooperating cam surface on the hammer to release the hammer from the sear as the breechblock reaches the fully-closed position, in which a firing pin carried by the breechblock attains correct alignment with a shell in the gun chamber. A set screw provides an adjustable cam surface on the hammer to allow the correlation of the timing of the hammer release with the breechblock movement to be readjusted precisely as the parts wear with use.

12 Claims, 7 Drawing Figures

PERCUSSION FIRING MECHANISM FOR INDUSTRIAL GUNS

This invention relates to industrial guns of the type having a breechblock which is slidable transversely of the axis of the barrel, between an open position in which the chamber is accessible for loading of a shell, and a closed position in which the breechblock fully encloses the base of the shell for firing. The invention is particularly concerned with an improved firing mechanism for cocking and releasing a hammer to fire the gun, which mechanism is operated automatically by the action of opening and closing the breechblock.

Industrial guns of the kind in which this invention finds particular utility are of the type generally shown in U.S. Pat. Nos. 2,415,952 to Loomis, 2,977,855 to Catlin et al, and 3,763,742 to Kotas et al. Although guns of this kind have been used for many years for the purpose of firing slugs into cement kilns to break up clinker rings, a recent development has also applied them to the field of geophysical exploration, as a means of impacting the earth to generate seismic waves from which subterranean geology can be determined.

Early forms of such industrial guns were fired by a trigger or a lanyard, as in U.S. Pat. No. 2,415,952; this required a separate manual operation in addition to the loading of a shell into the gun, and the closing of the breechblock by moving an operating arm.

A need to fire kiln guns more rapidly and with less manipulation, led to the provision by U.S. Pat. No. 2,977,855 of a means for automatically firing the gun as a result of the action of closing the breechblock. To achieve this, a screw abutment is mounted in a bracket affixed to the breechblock, so that it displaces a toe portion attached to the sear as the breechblock closes. This releases the cocked hammer for impact against the firing pin. Adjustment of the point of release to coincide with the arrival of the breechblock at a closed position, in which the firing pin is properly aligned with the shell's primer, is obtained by appropriately resetting the screw abutment.

A disadvantage of the design in U.S. Pat. No. 2,977,855 is that the screw abutment device must be dismounted from the breechblock before the latter can be removed from the gun for routine cleaning or adjustment. Upon reassembly of the parts, the screw abutment must be readjusted to insure proper operation. Another shortcoming of this design is that the screw abutment does not begin to engage and release the sear until the stroke of the breechblock is nearly completed: therefore, the entire movement between the sear and hammer, from the fully engaged to disengaged relative positions, must be produced by a small displacement of the breechblock at the very end of its stroke. In practice, if there is either a slight maladjustment, or the parts are somewhat worn, it may require a very hard slamming of the breechblock to fire the gun.

Another means for achieving automatic firing by closing the breechblock appears in U.S. Pat. No. 3,763,742. Here, the sear is provided with a laterally-projecting cam portion, which is displaced by the operating arm to release the hammer as the arm completes its breechblock-closing movement. The critical timing of hammer release with the completion of breechblock closure is not adjustable. If the hammer is released before the breechblock reaches the fully-closed position, the firing pin will not be properly aligned with the primer of the shell, and a misfire may occur. But if the sear displacement is delayed too long, the hammer will not be released and the gun cannot be fired. This design therefore necessitates machining the parts to close tolerances. A final timing adjustment can be made at the factory by filing the sear cam.

Initially, the design of U.S. Pat. No. 3,763,742 has the advantage that the parts cannot become accidentally maladjusted in the field. However, as the parts wear with repeated use, the firing point occurs later and later in the breechblock-closing movement, until eventually the hammer and sear no longer disengage, and the gun therefore becomes inoperable. This can be corrected only by replacing the sear, and then filing the new sear to any extent necessary to obtain proper timing. Such repair work may result in troublesome delays, especially as it calls for the services of a fairly skillful gunsmith.

The present invention has as its general object the improvement of a percussion firing mechanism of an industrial gun of the type having a transverse sliding breechblock. The improved mechanism features a simplified construction, employing only the sear both to cock and to fire the hammer. The invention also provides a convenient means for easily but accurately adjusting the timing of the firing point in the field. The mechanism includes interengaging teeth on the hammer and sear, which is in itself conventional, to cock the hammer as the breechblock begins its movement from open to closed position. According to the invention, cooperating cam surfaces are formed on the hammer and sear, and these surfaces are arranged to come into contact and begin to separate the interengaged teeth before the end of the closing movement. This separation continues at a gradual rate as the breechblock closes. When the breechblock reaches the end of its motion and the firing pin comes into alignment with a shell seated in the gun chamber, the cam surfaces complete this tooth separation, releasing the hammer to impact the firing pin and discharge the gun.

To provide for adjustment of the firing point, that is, the timing of hammer release, one of the cooperating cam surfaces of the hammer and sear has a height adjustment. This preferably takes the form of a set screw threaded into the hammer, so that its head forms one of the cam surfaces. A locking screw may be threaded into the hammer at right angles to the set screw to secure it in adjusted position. As the parts wear with repeated use, it is a simple matter to readjust the projection of the set screw from the hammer, so that it releases the hammer from engagement with the sear just as the breechblock reaches its fully closed position.

Figure 1:
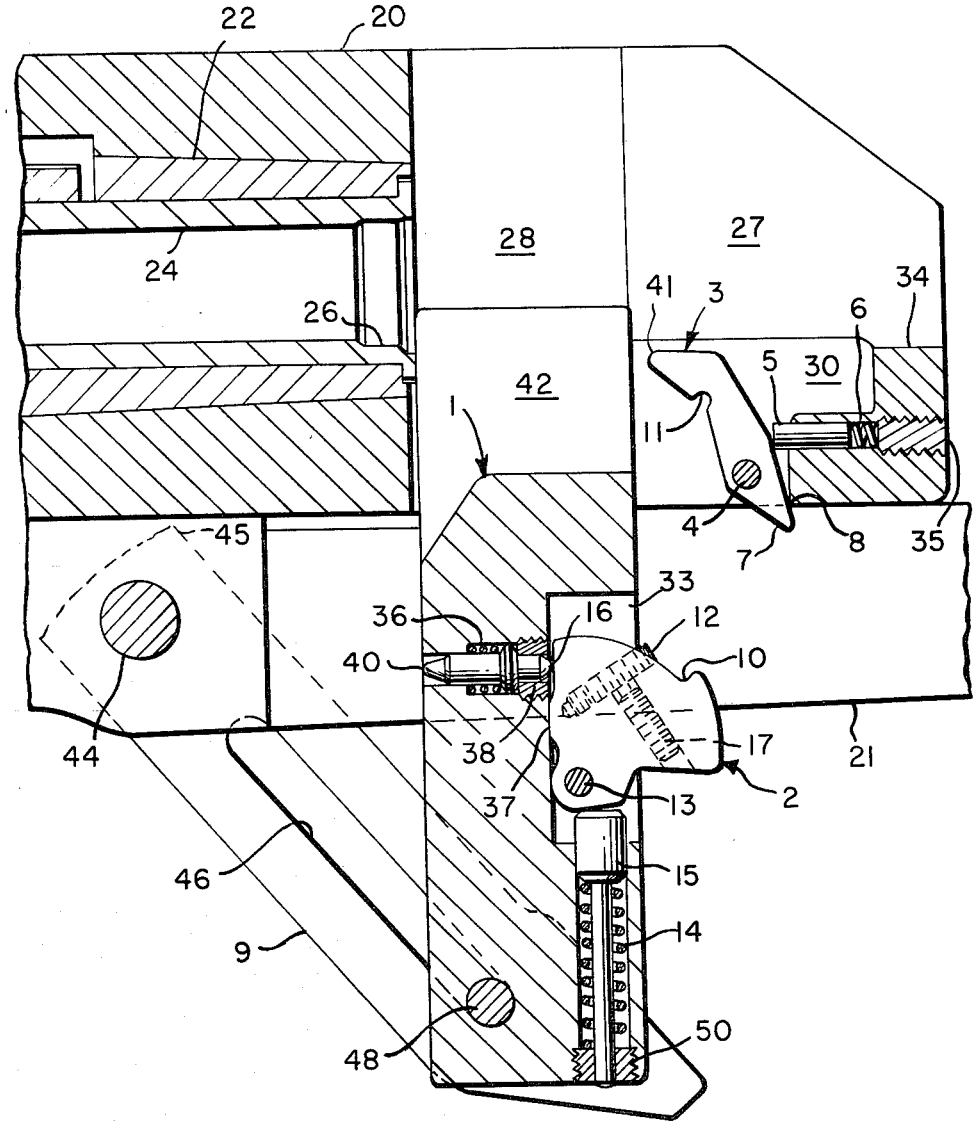
FIG. 1 is a fragmentary cross-sectional view in side elevation of an industrial gun according to a preferred embodiment of the invention, with a breechblock shown in its fully-open position.

Referring to FIGS. 1–5, an industrial or kiln gun is shown whose general features are of a type that is fully described in the aforementioned U.S. Pat. Nos. 2,415,952; 2,977,855; and 3,763,742. The gun has a frame 21 on which are secured a yoke or receiver 20, and a barrel 22 mounted in the yoke. As illustrated, the barrel has a liner 24 of wear-resistant alloy steel, in which a chamber 26 is formed for receiving a conventional ammunition shell suitable for the intended use of the gun.

The yoke 20 is formed with mortised passage 28 (see FIG. 5) adjacent to the breech of the barrel 24, and a breechblock 1 is slidable in this passage, transversely to the axis of the barrel. An operating arm 9 is pivoted at 44 in the frame 21, and a pin 48 secured to the breechblock is slidably received in an elongated slot 46 in the operating arm. By turning a handle portion 45 of the operating arm, the breechblock may be reciprocated between an open position shown in FIG. 1, and a closed position shown in FIG. 4. The yoke is formed with a U-shaped recess 27, and the breechblock with a complementary recess 42, to permit loading of shells into the chamber 26 when the breechblock is open, and ejection of spent shells after firing.

At the bottom of the recess 27, the yoke has a slot 30, in which a sear 3 is pivotally mounted on a pin 4. The sear is biased counterclockwise as seen in FIG. 1, by means of a plunger 5 and spring 6 received in a bridge portion 34 of the yoke, and retained by a screw 35. A corner portion 8 of the bridge 34 limits counterclockwise movement of the sear to the position shown in FIG. 1.

A hammer 2 is pivotally mounted on a pin 13 within a recess 33 in the rear face of the breechblock, and is biased counterclockwise by a plunger 15 and spring 14, which are retained by a screw plug 50. The hammer is shown in its uncooked or fired position in FIG. 1, to which it is limited by the abutment of a projection 37 against the wall of the recess 33.

A firing pin 16 is received in a stepped bore extending through the breechblock, and is biased to the right, as viewed in FIG. 1, against a retaining plug 38 by a spring 36. The firing pin is shown in FIGS. 1–3 and 5 in a retracted position, with its tip 40 substantially flush with the forward face of the breechblock. In this position, the breechblock can be closed without striking the tip 40. The front surface of the hammer 2 which is engageable with the firing pin is recessed behind the projection 37 enough to allow the firing pin to be retracted in this fashion.

Figure 2:
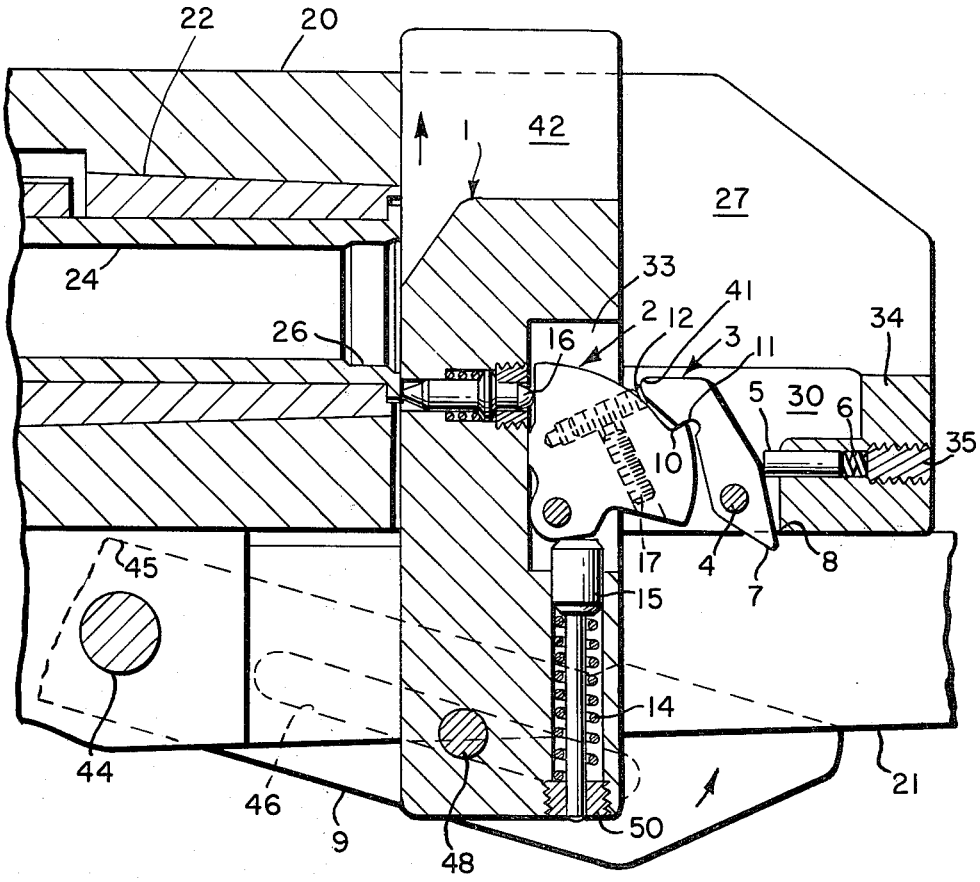
FIG. 2 is a view similar to FIG. 1, but showing the breechblock moved to a partially-closed position in which a hammer and a sear make their initial contact.
Figure 3:
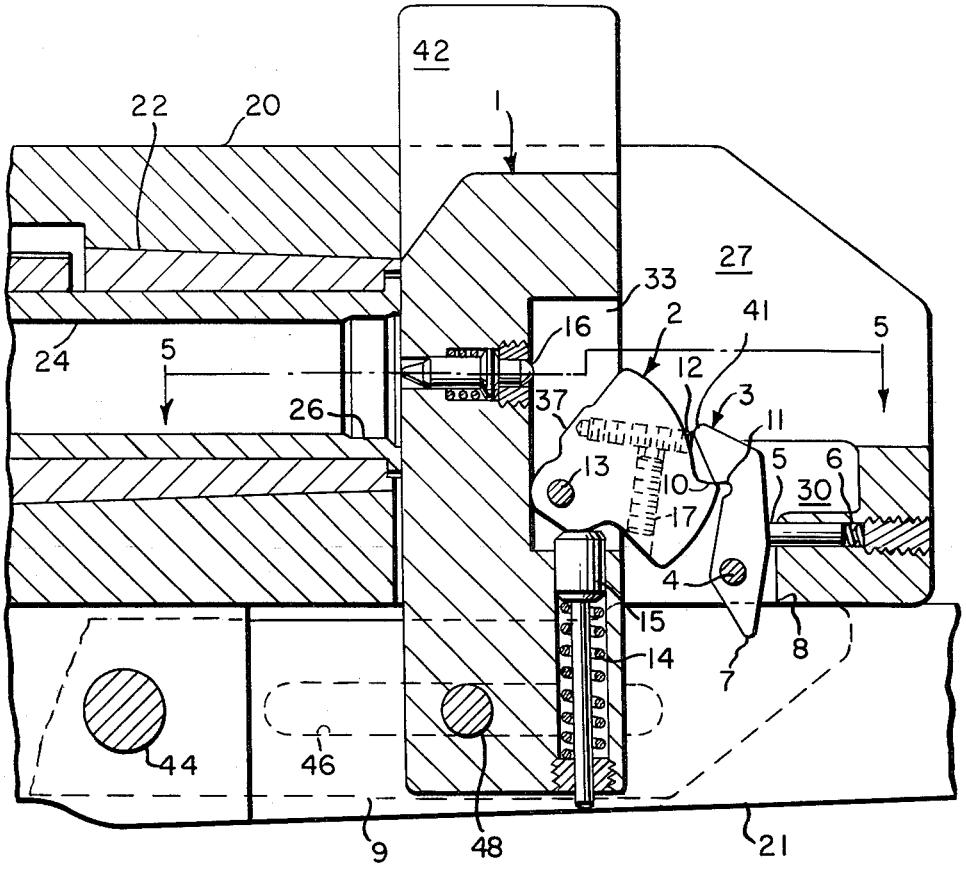
FIG. 3 is a view similar to FIG. 2, but showing the breechblock fully closed, and the sear and hammer disengaging to fire the gun.

Rotation of the operating arm 9 produces an upward closing movement of the breechblock 1 transverse to the axis of the barrel 24, as shown by the arrows in FIG. 2. The hammer 2 is formed with a tooth 10, and the sear 3 with a tooth 11. These teeth are aligned vertically in the direction of breechblock movement, so that they interengage with one another at the intermediate stage of breechblock closure illustrated in FIG. 2. Continuation of the closing movement cocks the hammer 2 by turning it clockwise as shown in FIG. 3, compressing the hammer spring 14.

Figure 6:
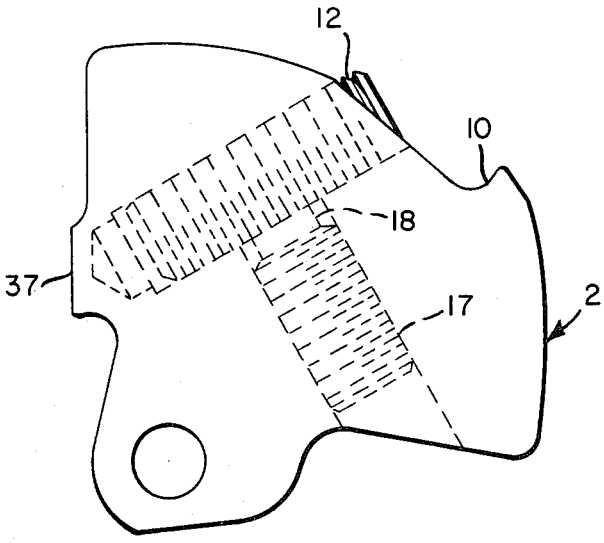
FIG. 6 is a view in side elevation, and on an enlarged scale, of the hammer assembly.
Figure 7:
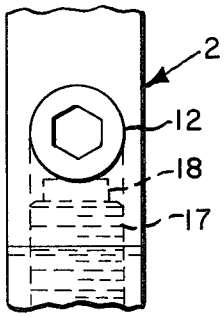
FIG. 7 is a fragmentary view in rear elevation of a portion of the hammer assembly.

The sear 3 has a cam surface or nose 41 and the hammer is provided with a cooperating cam surface, which comprises a set screw 12 in the preferred embodiment. The screw 12 is adjustably threaded in the body of the hammer, as is shown on an enlarged scale in FIGS. 6 and 7, and is fixed in adjusted position by means of a transversely-threaded lock screw 17. A brass tip 18 is provided on the lock screw to prevent damage to the threads of the set screw 12.

At, or shortly after, the stage of initial engagement of the teeth 10 and 11 shown in FIG. 2, the nose 41 contacts the head of the set screw 12. As the closing movement continues toward the stage of FIG. 3, the clockwise rotation of the hammer causes the nose and set screw to rotate the sear 3 in a clockwise direction. This gradually separates the teeth 10 and 11, until in FIG. 3 they are on the verge of disengaging from one another.

Figure 4:
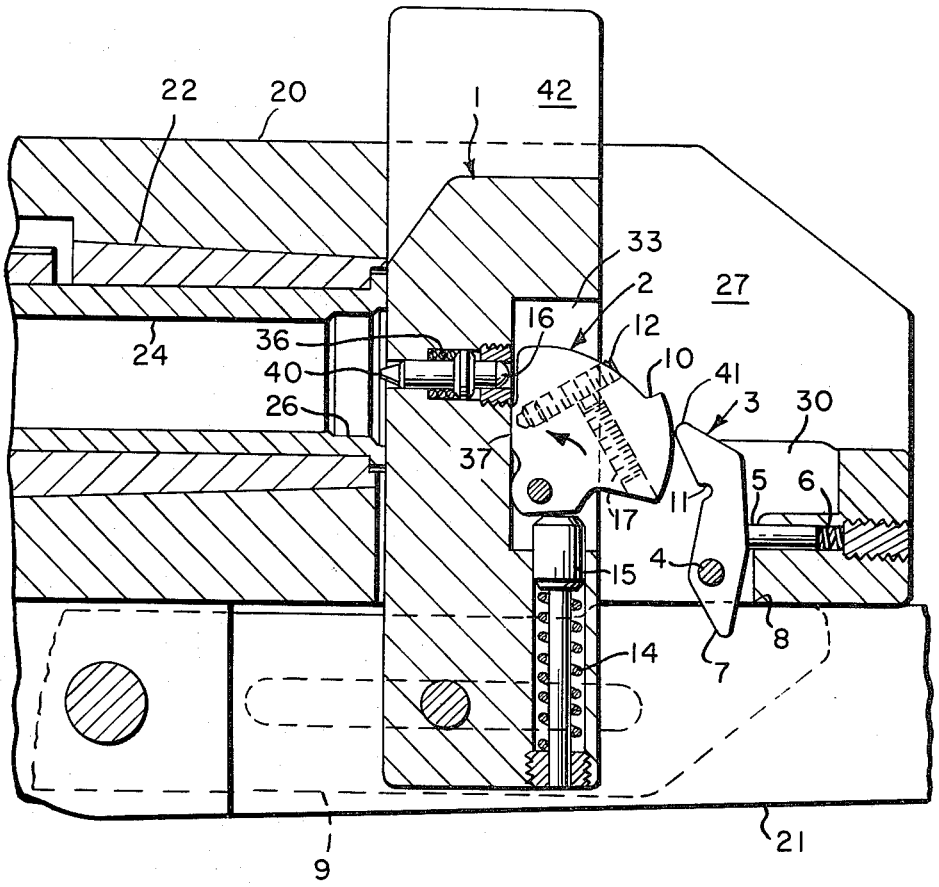
FIG. 4 is a view similar to FIG. 3, but showing the positions of the hammer, sear, and firing pin after firing has occurred.
Figure 5:
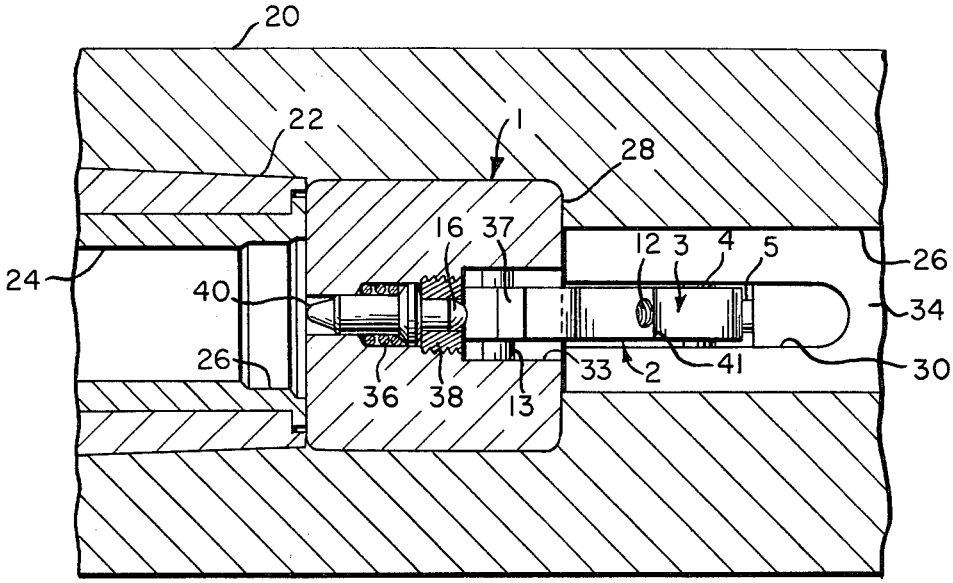
FIG. 5 is a sectional view taken along line 5—5 in FIG. 3, looking in the direction of the arrows.

A very slight additional motion of the breechblock to the closed position of FIG. 4 releases the hammer, allowing its spring 14 to drive it counterclockwise into inertial impact with the firing pin 16. The hammer is arrested in this position by the protrusion 37, while the momentum imparted to the firing pin drives its tip 40 forward to indent the primer (not shown) of a cartridge received in the chamber 26.

When a stage of wear of the nose 41 or set screw 12 is reached such that they are no longer effective to release the hammer by separating the teeth 10 and 11, corrective adjustment may be made readily in the field, without removing any parts from the gun.

First, the breechblock 1 is opened to the position of FIG. 1, by turning the operating arm 9 in a clockwise direction. This affords access to the hammer lock screw 17, which is backed out a few turns, out of contact with the set screw 12. Then the breechblock is closed to the position of FIG. 4, and the hammer 2 is manually released by pressing a tail portion 7 of the sear in a clockwise direction, so as to separate the teeth 10 and 11. The set screw 12 is next backed out to a position such that when the breechblock is once more cycled to the open and closed positions, the hammer will be automatically released from the sear. Once the correct setting of the set screw 12 has been determined, it is locked in this position by reopening the breechblock and retightening the lock screw 17. This method of adjustment requires no tools other than a screwdriver or Allen-head wrench, as appropriate to the screws 12 and 17, and does not call for any of the skills of a gunsmith.

It will be understood that a number of modifications may be made in the illustrated construction without departing from the invention. The cam-surface adjustment feature provided by the set screw 12 may be omitted if desired, although this would require replacement of the sear 3 when it becomes too worn to release the hammer. Also, the cam-surface adjustment may take the form of an adjustable screw threaded into the sear 3, provided that this member is dimensioned to provide an adequate threaded hole to support the screw securely.

We claim:

1. In an industrial gun which includes a barrel having a shell-receiving chamber; a breechblock; a yoke secured to said barrel and formed with a passage extending transversely to the length of said barrel and opening into said chamber, said passage receiving said breechblock for sliding movement therein; and means for displacing said breechblock in said passage transversely of said barrel, between an open position in which said chamber is open for loading, and a closed position; a firing pin; a hammer movably mounted in said breechblock and resiliently biased for movement from a cocked position toward a fired position contacting said firing pin; a sear mounted in said yoke for releasably latching said hammer in said cocked position; said sear and said hammer being constructed and arranged for mutual latching engagement at an intermediate stage of movement of said breechblock from said open toward said closed position, said sear acting, during subsequent movement of said breechblock toward said closed position, to displace said hammer toward said cocked position; the improved firing mechanism which comprises:

cooperating cam means formed on said hammer and said sear, said cam means being mutually engageable by said displacement of said hammer toward said cocked position, said cam surfaces being constructed and arranged to disengage said hammer from latching engagement with said sear for movement to said fired position substantially coincident with the completion of movement of said breechblock to said closed position.

2. A firing mechanism as recited in claim 1, in which at least one of said cam means includes adjusting means to control the timing of disengagement of said hammer from said sear relative to the completion of movement of said breechblock to said closed position.

3. A firing mechanism as recited in claim 2, in which said adjusting means comprises a set screw having a head forming one of said cam means of said sear and said hammer.

4. A firing mechanism as recited in claim 2, in which said adjusting means comprises a set screw threaded into said hammer and forming said cam means thereof.

5. A firing mechanism as recited in claim 4, together with a lock screw threaded into said hammer and engageable with said set screw to secure said set screw in adjusted position.

6. A firing mechanism as recited in claim 1, said sear being formed with a projecting nose portion comprising said cam means thereof.

7. In an industrial gun which includes a barrel having a shell-receiving chamber; a breechblock; a yoke secured to said barrel and formed with a passage extending transversely to the length of said barrel and opening into said chamber, said passage receiving said breechblock for sliding movement therein; means for displacing said breechblock in said passage transversely of said barrel, between an open position in which said chamber is open for loading a shell therein, and a closed position; a firing pin slidably mounted in said breechblock for movement between a retracted position and a firing position; and means biasing said firing pin toward said retracted position; an improved percussion firing mechanism which comprises, in combination:

a hammer having a tooth and mounted in said breechblock for movement between a cocked position withdrawn from said firing pin, and a fired position for impelling said firing pin toward firing position; means biasing said hammer toward said fired position;

a sear having a tooth and mounted in said yoke for movement between a latching position in which the teeth of said hammer and said sear are engageable, and a released position in which said teeth are disengaged; means biasing said sear toward said latching position;

said sear and said hammer being constructed and arranged for mutual engagement of said teeth thereof at an intermediate stage of movement of said breechblock from said open toward said closed position; said sear, in said latching position, acting during subsequent movement of said breechblock toward said closed position, to displace said hammer toward said cocked position;

said sear and said hammer being formed with cam surfaces mutually engageable by said displacement of said hammer toward said cocked position, said cam surfaces being constructed and arranged to displace said sear toward said released position during said subsequent movement of said breechblock, and to disengage said teeth to release said hammer for movement to said fired position substantially coincident with the completion of movement of said breechblock to said closed position.

8. A percussion firing mechanism as recited in claim 7, in which at least one of said cam surfaces includes adjusting means to control the timing of disengagement of said teeth relative to the completion of movement of said breechblock to said closed position.

9. A percussion firing mechanism as recited in claim 8, in which said adjusting means comprises a set screw having a head forming one of said cam surfaces of said sear and said hammer.

10. A percussion firing mechanism as recited in claim 8, in which said adjusting means comprises a set screw threaded into said hammer and forming said cam surface thereof.

11. A percussion firing mechanism as recited in claim 10, together with a lock screw threaded into said hammer and engageable with said set screw to secure said set screw in adjusted position.

12. A percussion firing mechanism as recited in claim 7, said sear being formed with a projecting nose portion comprising said cam surface thereof.

* * * * *